US009057991B2

(12) United States Patent
Shimizu et al.

(10) Patent No.: US 9,057,991 B2
(45) Date of Patent: Jun. 16, 2015

(54) IMAGE FORMING APPARATUS

(75) Inventors: Yasunobu Shimizu, Kanagawa (JP); Hiroyoshi Haga, Kanagawa (JP); Tomokazu Takeuchi, Tokyo (JP); Hiromi Ogiyama, Tokyo (JP); Kenji Sengoku, Kanagawa (JP); Junpei Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 364 days.

(21) Appl. No.: 13/485,151

(22) Filed: May 31, 2012

(65) Prior Publication Data

US 2012/0315058 A1 Dec. 13, 2012

(30) Foreign Application Priority Data

Jun. 8, 2011 (JP) ..... 2011-128185
Mar. 16, 2012 (JP) ..... 2012-060055

(51) Int. Cl.
*G03G 15/16* (2006.01)

(52) U.S. Cl.
CPC ..... *G03G 15/1605* (2013.01); *G03G 15/1645* (2013.01)

(58) Field of Classification Search
CPC ..... G03G 15/14; G03G 15/1625; G03G 15/1645; G03G 15/1675
USPC ..... 399/45, 66
See application file for complete search history.

(56) References Cited

U.S. PATENT DOCUMENTS 4,134,147 A * 1/1979 Watanabe ..... 361/235
4,528,937 A 7/1985 Kanno et al.
4,851,874 A 7/1989 Ogiyama
5,029,840 A 7/1991 Haga et al.
5,483,330 A 1/1996 Ogiyama et al.
5,991,570 A 11/1999 Haga et al.
6,405,002 B2 6/2002 Ogiyama et al.
6,618,565 B2 9/2003 Tamiya et al.
6,697,595 B2 2/2004 Kawagoe et al.
6,741,821 B2 5/2004 Sugino et al.
6,785,500 B2 8/2004 Takahashi et al.
6,829,450 B2 12/2004 Tamiya et al.
6,901,234 B2 5/2005 Ogiyama et al.

(Continued)

FOREIGN PATENT DOCUMENTS

JP 4-86878 3/1992
JP 9-146381 6/1997

(Continued)

*Primary Examiner* — David Gray
*Assistant Examiner* — Thomas Giampaolo, II
(74) *Attorney, Agent, or Firm* — Oblon, McClelland, Maier & Neustadt, L.L.P.

(57) ABSTRACT

An image forming apparatus includes an image carrier; a facing member facing the image carrier via a transfer position; a power supply to output a voltage between a first position on the image carrier side and a second position on the facing member side; a resistance detector to detect electrical resistance between the first position and the second position via the transfer position; and a controller to switch between a first transfer mode in which the power supply outputs a direct current voltage, and a second transfer mode in which the power supply outputs a superimposed voltage. When a toner image on the image carrier is transferred onto a recording medium at the transfer position, the controller selects either the first transfer mode or the second transfer mode. When the resistance detector detects the electrical resistance, the controller selects the first transfer mode.

30 Claims, 10 Drawing Sheets

(56) References Cited

U.S. PATENT DOCUMENTS

| | | | | |
|---|---|---|---|---|
| 7,003,238 | B2 | 2/2006 | Yoshida et al. | |
| 7,203,433 | B2 | 4/2007 | Kato et al. | |
| 7,277,657 | B2 | 10/2007 | Uchida et al. | |
| 7,280,792 | B2 | 10/2007 | Sawai et al. | |
| 7,346,287 | B2 | 3/2008 | Ogiyama et al. | |
| 7,610,004 | B2 | 10/2009 | Kato et al. | |
| 7,773,928 | B2 | 8/2010 | Ogiyama et al. | |
| 8,135,319 | B2 | 3/2012 | Fujita | |
| 2003/0118359 | A1 | 6/2003 | Ogiyama et al. | |
| 2008/0232867 | A1 | 9/2008 | Minbu et al. | |
| 2010/0040386 | A1 | 2/2010 | Mizutani et al. | |
| 2010/0067952 | A1 | 3/2010 | Fujita et al. | |
| 2010/0080631 | A1 | 4/2010 | Ogiyama et al. | |
| 2010/0098446 | A1 | 4/2010 | Ishikawa et al. | |
| 2010/0142985 | A1 | 6/2010 | Minbe et al. | |
| 2010/0221029 | A1 | 9/2010 | Minbu et al. | |
| 2010/0329707 | A1* | 12/2010 | Yamada | 399/44 |
| 2011/0064487 | A1 | 3/2011 | Ichihashi et al. | |
| 2011/0158690 | A1 | 6/2011 | Mimbu et al. | |
| 2011/0181116 | A1 | 7/2011 | Takeuchi et al. | |
| 2011/0206399 | A1 | 8/2011 | Fujita et al. | |
| 2011/0286759 | A1 | 11/2011 | Ichihashi et al. | |
| 2011/0293312 | A1 | 12/2011 | Mimbu et al. | |
| 2012/0008991 | A1 | 1/2012 | Shimizu | |
| 2012/0045237 | A1 | 2/2012 | Aoki et al. | |
| 2012/0213536 | A1 | 8/2012 | Takeuchi | |
| 2012/0224879 | A1 | 9/2012 | Fujita et al. | |
| 2012/0230715 | A1 | 9/2012 | Ogino et al. | |
| 2012/0237260 | A1 | 9/2012 | Sengoku et al. | |
| 2012/0237271 | A1 | 9/2012 | Sengoku et al. | |
| 2012/0308250 | A1 | 12/2012 | Shimizu et al. | |
| 2012/0328320 | A1* | 12/2012 | Fujita et al. | 399/88 |
| 2013/0004190 | A1 | 1/2013 | Sengoku et al. | |

FOREIGN PATENT DOCUMENTS

| | | | |
|---|---|---|---|
| JP | 2003-118158 | | 4/2003 |
| JP | 2006-267486 | | 10/2006 |
| JP | 2006267486 | A * | 10/2006 |
| JP | 2008-58585 | | 3/2008 |
| JP | 2008-170929 | | 7/2008 |

* cited by examiner

SECONDARY TRANSFER:
DC CONSTANT CURRENT
CONTROL/VOLTAGE DETECT

SECONDARY TRANSFER:
AC SUPERIMPOSED
TRANSFER CONTROL

IMAGE FORMING APPARATUS

CROSS-REFERENCE TO RELATED APPLICATIONS

This patent application is based on and claims priority pursuant to 35 U.S.C. §119 to Japanese Patent Application Nos. 2011-128185, filed on Jun. 8, 2011 and 2012-060055, filed on Mar. 16, 2012 in the Japan Patent Office, the entire disclosures of which are hereby incorporated by reference herein.

BACKGROUND

1. Technical Field

The present disclosure relate to an image forming apparatus, such as a copier, a facsimile machine, a printer, or a multi-functional system including a combination thereof.

2. Description of the Related Art

In electrophotographic image forming apparatuses, an electrostatic latent image, which is obtained by forming optical image data on an image carrier (e.g., a photoconductor) that is uniformly charged in advance, is rendered visible with toner from a development device. An image is formed on a recording medium by transferring the visible image directly or indirectly onto the recording medium (e.g., transfer sheet) via an intermediate transfer member and fixing the image thereon.

In a thus-configured image forming apparatus, a constant current control method to control a direct current (DC) transfer bias applied to a transfer member using a direct current (DC) power source is widely used. In constant current control, an output voltage from a bias application circuit is detected by a detection circuit provided to the bias application circuit, and a resistance of a transfer unit roller (i.e., resistance including the image carrier and the recording medium) is calculated based on the detected output voltage to determine a transfer current value.

However, at present, various types of recording media, for example, waved laser-like paper having premium accent or Japanese paper, are widely sold. In these papers, in order to create luxurious mode, surfaces of the papers have asperities with embossed effect. The toner in a concave portion of the paper is hardly transferred, compared to a convex portion thereof. More particularly, when the toner is transferred on the recording medium having large asperity, the toner cannot be transferred on the concave portion sufficiently, which may generate image failure in which toner image is partly absent.

In order to solve the transfer failure in the concave portion of the recording media, the related art discloses an approach in which a superimposed bias in which an alternating current (AC) voltage is superimposed on a direct current (DC) voltage is applied, and as a result, transfer efficiency is improved and image failure alleviated. In this configuration, in order to switch between the DC transfer mode and the superimposed transfer mode, the image forming apparatus has a DC power source to apply a DC transfer bias and a superimposed power source (AC+DC power source) to apply the superimposed bias.

In addition, the DC power source can be used to detect the resistance of the transfer portion to correct the value of an applied transfer bias.

However, with a superimposed bias, the resistance cannot be accurately calculated due to fluctuations in the alternating-current voltage over time.

SUMMARY

In one aspect of this disclosure, there is provided an image forming apparatus including an image carrier, a facing member, a power supply, a resistance detector, and a controller. The image carrier bears a toner image. The facing member is disposed opposite and facing the image carrier via a transfer position at which the toner image is transferred onto a recording medium from the image carrier. The power supply outputs a voltage between a first position on the image carrier side from the transfer position and a second position on the facing member side from the transfer position. The resistance detector detects electrical resistance between the first position and the second position via the transfer position. The controller selectively switches between a first transfer mode, in which the power supply outputs a direct current voltage, and a second transfer mode, in which the power supply outputs a superimposed voltage in which an alternating current voltage is superimposed on a direct current voltage. When the toner image on the image carrier is transferred onto the recording medium at the transfer position, the controller selects either the first transfer mode or the second transfer mode. When the resistance detector detects the electrical resistance between the first position and the second position via the transfer position, the controller selects the first transfer mode.

BRIEF DESCRIPTION OF THE DRAWINGS

The aforementioned and other aspects, features, and advantages will be better understood by reference to the following detailed description when considered in connection with the accompanying drawings, wherein.

DETAILED DESCRIPTION OF PREFERRED EMBODIMENTS

Figure 1:
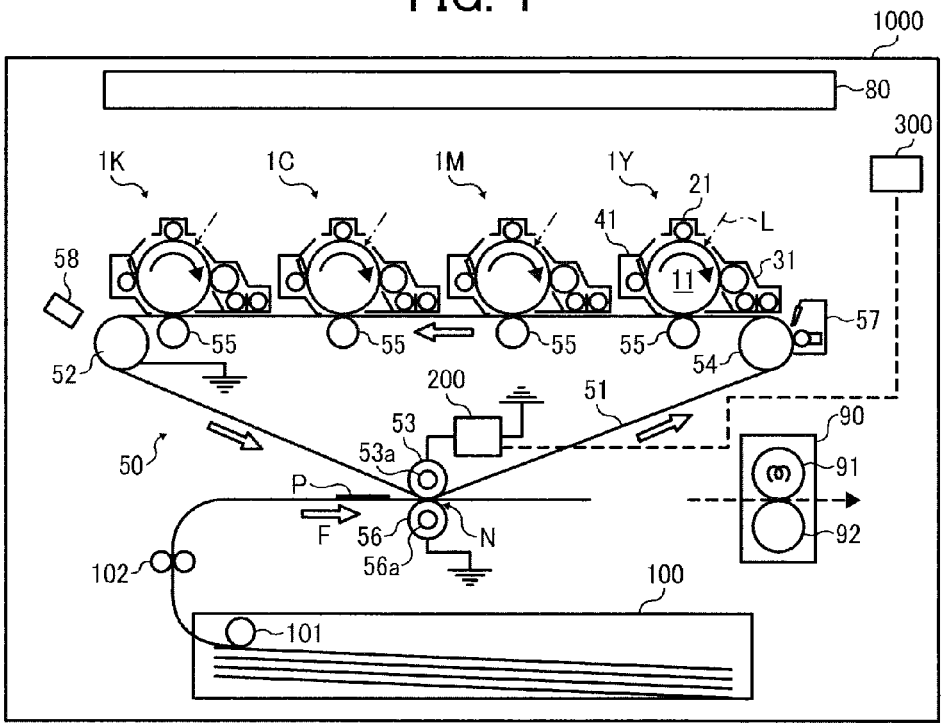
FIG. 1 is a schematic diagram illustrating an image forming apparatus according to the present disclosure.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, particularly to FIGS. 1 through 11, image forming apparatus according to illustrative embodiments are described. It is to be noted that although the image forming apparatus of the present embodiment is described as a printer, the image forming apparatus of the present invention is not limited thereto. In addition, it is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

(Configuration of Image Forming Apparatus)

FIG. 1 is a schematic diagram illustrating a color printer as an example of the image forming apparatus 1000 according to an illustrative embodiment of the present invention. As illustrated in FIG. 1, the image forming apparatus 1000 includes four image forming units 1Y, 1M, 1C, and 1K for forming toner images, one for each of the colors yellow, magenta, cyan, and black, respectively, a transfer unit 50, an optical writing unit 80, a fixing device 90, a sheet cassette 100, and a pair of registration rollers 102. The image forming apparatus 1000 includes an endless belt (intermediate transfer belt 51) as an intermediate transfer member. The four image forming units 1Y, 1M, 1C, and 1K for forming toner images are provided aligned to an upper portion of the intermediate transfer belt 51, which forms a tandem image forming unit.

It is to be noted that the suffixes Y, M, C, and K denote colors yellow, magenta, cyan, and black, respectively. To simplify the description, these suffixes Y, M, C, and K indicating colors are omitted herein, unless otherwise specified. The image forming units 1Y, 1M, 1C, and 1K all have the same configuration, differing only in the color of toner employed. Thus, a description is provided below of the image forming unit 1K for forming a toner image of black as a representative example of the image forming units 1. The image forming units 1Y, 1M, 1C, and 1K are replaceable, and are replaced upon reaching the end of their product life cycles.

Figure 2:
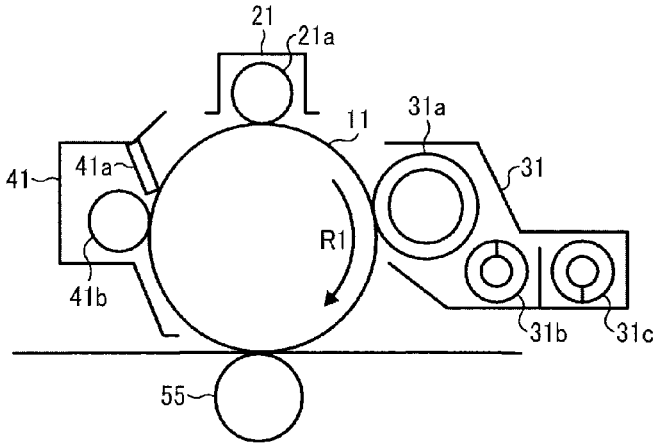
FIG. 2 is a schematic diagram illustrating an image forming unit included in the image forming apparatus shown in FIG. 1.

With reference to FIG. 2, a description is provided of the image forming unit 1K as an example of the image forming units 1. FIG. 2 is a schematic diagram illustrating the image forming unit 1K. A photoconductive drum (serving as photoconductor and photoreceptor) 11K serving as a latent image bearing member is surrounded by various pieces of imaging equipment, such as a charging device 21, a developing device 31, a drum cleaner 41, and a charge neutralizing device (not illustrated). These devices are held by a common holder so that they are detachably attachable and replaced at the same time.

The photoconductive drum 11K essentially consists of a drum-shaped base on which an organic photoconductive layer is disposed, with the external diameter of approximately 60 mm. The photoconductive drum 11K is rotated clockwise (indicated by arrow R1 in FIG. 2) by a driving device. The charging device 21K includes a charging roller 21*a* supplied with a charging bias. The charging roller 21*a* contacts or approaches the photoconductive drum 11 to generate an electrical field therebetween, thereby charging uniformly the surface of the photoconductive drum 11. According to the illustrative embodiment, the photoconductive drum 11 is uniformly charged to a negative polarity which is the same charging polarity as toner.

As the charging bias, an alternating current voltage superimposed on a direct current voltage is employed. The charging roller 21*a* comprises a core metal consisting of a metal rod coated with a conductive elastic layer made of a conductive elastic material. Alternatively, a corona charger may be employed instead of the charging roller 21*a*.

The developing device 31 includes a developing sleeve 31 serving as a developer carrier, screw conveyors 31*b* and 31*c* to mix a developer for black and transports the developing agent. It is to be noted that although two-component developer including toner and carrier is used in the above-described embodiments, the development device 31 may contain only single-component developer consisting essentially of only toner.

The drum cleaner 41 includes a cleaning blade 41*a* and a brush roller 41*b*. The brush roller 41*b* rotates and brushes off the residual toner from the surface of the photoconductive drum 11 while the cleaning blade 41*a* removes the residual toner by scraping. A charge neutralizer removes residual charge remaining on the photoconductive drum 11K after the surface thereof is cleaned by the drum cleaner 41 in preparation for the subsequent imaging cycle.

Referring again to FIG. 1, the optical writing unit 80 for writing a latent image on the photoconductive drums 11 is disposed above the image forming units 1Y, 1M, 1C, and 1K. Based on image information received from an external device such as a personal computer (PC), the optical writing unit 80 illuminates the photoconductive drums 11Y, 11M, 11C, and 11K with a light beam projected from a laser diode of the optical writing unit 80. Accordingly, the electrostatic latent images of yellow, magenta, cyan, and black are formed on the photoconductive drums 11Y, 11M, 11C, and 11K, respectively.

More specifically, the electrical potential of the portion of the charged surface of the photoconductive drum 11 illuminated with the light beam is attenuated. The electrical potential of the illuminated portion of the photoconductive drum 11 is less than the electrical potential of the other area, that is, the background portion (non-image portion), thereby forming the electrostatic latent image on the photoconductive drum 11.

The optical writing unit 80 includes a polygon mirror rotated by a polygon motor, a plurality of optical lenses, and mirrors. The light beam projected from the laser diode serving as a light source is deflected in a main scanning direction by the polygon mirror. The deflected light then strikes the optical lenses and mirrors, thereby scanning the photoconductive drum 11. The optical writing unit 80 may employ a light source using an LED array including a plurality of LEDs that project light.

Referring back to FIG. 1, a description is provided of the transfer unit 50. The transfer unit 50 is disposed below the image forming units 1Y, 1M, 1C, and 1K. The transfer unit 50 includes the intermediate transfer belt 51 serving as an image bearer formed into an endless loop and rotated counterclockwise. The transfer unit 50 also includes a driving roller 52, a secondary-transfer rear roller 53, a cleaning backup roller 54, an nip forming roller 56, a belt cleaning device 57, an electric potential detector 58, four primary transfer rollers 55Y, 55M, 55C, and 55K, and so forth.

The intermediate transfer belt 51 is entrained around and stretched taut between the driving roller 52, the secondary-transfer rear roller 53, the cleaning backup roller 54, and the primary transfer rollers 55Y, 55M, 55C, and 55K (hereinafter collectively referred to as the primary transfer rollers 55, unless otherwise specified). The driving roller 52 is rotated counterclockwise by a motor or the like, and rotation of the driving roller 52 enables the intermediate transfer belt 51 to rotate in the same direction.

The intermediate transfer belt 51 of the present embodiment has a thickness in a range of from 20 μm to 200 μm, preferably approximately 60 μm. The surface resistivity of the intermediate transfer belt 51 is within 9.0 log Ωcm to 13.0 log Ω·cm, preferably, 10.0 log Ω/cm$^2$ to 12.0 log Ω/cm$^2$. The surface resistivity is measured with an applied voltage of 500V for 10 seconds, using a high resistivity meter, in this case a Hiresta UPMCPHT 45 manufactured by Mitsubishi Chemical Corporation. The volume resistivity thereof is in a range of from 6.0 log Ωcm to 13.0 log Ωcm, preferably approximately 9 log Ωcm. The volume resistivity is measured with an applied voltage of 100V using a high resistivity meter, in this case a Hiresta UPMCPHT 45 manufactured by Mitsubishi Chemical Corporation.

The intermediate transfer belt 51 is made of either a single layer or multiple layers composed of Polyimide (PI), Poly Vinylidene DeFluoride (PVDF), Ethylene Tetra Fluoro Etylene (ETFT), and Polycarbpnate (PC).

In addition, optionally, the surface of the intermediate transfer belt 51 may be coated with a release layer as needed. The coating material is of fluoro resin, for example, ETFT, poly Tetra Fluoro Ethylene (PTFE), FET, PVT, although the material is not limited thereto.

The intermediate transfer belt 51 is manufactured by casting or centrifugal molding, and the surface thereof may be polished as needed. Alternatively, the intermediate transfer belt 51 may be constituted as a three-layered endless belt having a base layer, an intermediate elastic layer, and a surface coating layer. When the three-layered belt is used, the base layer is made of fluorocarbon polymers having poor extensibility or a composite material composed of rubber having great extendibility and a canvas having poor extensibility. The elastic layer is made of, for example, fluorocarbon rubber, or acryleritrile-butadiene copolymer, which is formed on the base layer. The coating layer is formed by applying the fluorocarbon polymers onto the elastic layer. The resistivity is adjusted by dispersing electrically conductive material, such as carbon black, therein.

The intermediate transfer belt 51 is interposed between the photoconductive drums 11 and the primary transfer rollers 55. Accordingly, a primary transfer nip is formed between the outer surface of the intermediate transfer belt 51 and the photoconductive drums 11. The primary transfer rollers 55 are supplied with a primary bias by a transfer bias power source, thereby generating a transfer electric field between the toner images on the photoconductive drums 11 and the primary transfer rollers 55.

The toner image Y of yellow formed on the photoconductive drum 11Y enters the primary transfer nip as the photoconductive drum 11Y rotates. Subsequently, the toner image Y is transferred from the photoconductive drum 11Y to the intermediate transfer belt 51 by the transfer electrical field and the nip pressure. As the intermediate transfer belt 51 on which the toner image of yellow is transferred passes through the primary transfer nips of magenta, cyan, and black, the toner images on the photoconductive drums 11M, 11C, and 11K are superimposed on the toner image Y of yellow, thereby forming a composite toner image on the intermediate transfer belt 51 in the primary transfer process.

In the case of monochrome imaging, a support plate supporting the primary transfer rollers 55Y, 55M, and 55C of the transfer unit 50 is moved to separate the primary transfer rollers 55Y, 55M, and 55C from the photoconductive drums 11Y, 11M, and 11C. Accordingly, the outer surface of the intermediate transfer belt 51, that is, the image bearing surface, is separated from the photoconductive drums 11Y, 11M, and 11C, so that the intermediate transfer belt 51 contacts only the photoconductive drum 11K. In this state, the image forming unit 1K is activated to form a black toner image on the photoconductive drum 11K.

In the present embodiment, each of the primary transfer rollers 55 is constituted of an elastic roller including a metal rod on which a conductive sponge layer is provided. The total external diameter thereof is approximately 16 mm. The diameter of the metal rod alone is approximately 10 mm. The volume resistivity thereof is in a range of from 6.0 log Ωcm to 8.0 log Ωcm, preferably approximately, within a range from 7.0 log Ωcm to 8.0 log Ωcm. The volume resistivity of the primary transfer roller 55 is detected by rotational measurement. That is, the resistivity is detected while 5 N weight is applied to one side, a 1 kV load is applied to a rotary shaft (metal rod) of the primary transfer roller 55, and the roller 55 is rotated one for 1 minute, and the detected average value is set as the volume resistivity thereof.

The resistance R of the sponge layer is in a range from 1eΩ to 1e9Ω preferably approximately 3e7Ω. The resistance is obtained by Ohm's law R=V/I, where V is voltage, I is current, and R is resistance. The primary transfer rollers 55 described above are supplied with a primary transfer bias through constant current control. According to this embodiment, a roller-type primary transfer device is used as the primary transfer roller 55. Alternatively, a transfer charger, a brush-type transfer device, and so forth may be employed as a primary transfer device (see FIGS. 13 and 17).

The nip forming roller 56 of the transfer unit 50 is disposed outside the loop formed by the intermediate transfer belt 51, opposite the secondary-transfer rear roller 53. The intermediate transfer belt 51 is interposed between the secondary-transfer rear roller 53 and the nip forming roller 56, thereby forming a secondary transfer nip between the outer surface of intermediate transfer belt 51 and the nip forming roller 56. The nip forming roller 56 is electrically grounded. The secondary-transfer rear roller 53 is supplied with a secondary transfer bias from a secondary transfer bias power supply 200.

With this configuration, a secondary transfer electric field is formed between the secondary-transfer rear roller 53 and the nip forming roller 56 so that the toner of negative polarity is transferred electrostatically from the secondary-transfer rear roller 53 side to the nip forming roller 56 side.

The sheet cassette 100 storing a stack of recording media sheets is disposed beneath the transfer unit 50. The sheet cassette 100 is equipped with a sheet feed roller 101 to contact a top sheet of the stack of recording media sheets. At an end of a sheet passage, the pair of registration rollers 102 is disposed. As the sheet feed roller 101 is rotated at a predetermined speed, the sheet feed roller 101 picks up the top sheet of the recording medium P and sends it to the sheet passage. Then, the pair of registration rollers 102 stops rotating temporarily as soon as the recording medium P is interposed therebetween. The pair of registration rollers 102 starts to rotate again to feed the recording medium P to the secondary transfer nip in appropriate timing such that the recording medium P is aligned with the composite toner image formed on the intermediate transfer belt 51 in the secondary transfer nip.

In the secondary transfer nip, the recording medium P tightly contacts the composite toner image on the intermediate transfer belt 51, and the composite toner image is transferred onto the recording medium P by the secondary transfer electric field and the nip pressure applied thereto. The recording medium P on which the composite color toner image is formed passes through the secondary transfer nip and separates from the nip forming roller 56 and the intermediate transfer belt 51 by self striping.

The secondary-transfer rear roller 53 is formed by a metal rod (core metal) 53*a* on which a resistive layer is laminated. The metal rod is made of stainless steel, aluminum, or the like. The resistive layer is formed of a polycarbonate, fluoro rubber, or silicone rubber, in which conductive particles (e.g., carbon and metal compound) are dispersed. Alternatively, the resistive layer may be formed of semi-conductive rubber, for example, polyurethane, nitirile rubber (NBR), etylene propylene rubber, (EPDM), or friction rubber NBR/ECO (epichlorohydrin rubber). A volume resistivity of the resistive layer is in a range of from $10^6\Omega$ to $10^{12}\Omega$, preferably from $10^7\Omega$ to $10^9\Omega$.

In addition, the secondary-transfer rear roller 53 may be formed of any type of a foamed rubber having a degree of hardness of from 20 to 50, or a rubber having a degree of hardness of from 30 to 60. With this structure, the white dots that form easily when the contact pressure between the intermediate transfer belt 51 and the secondary transfer rear roller 53 is increased can be prevented from occurring.

The nip forming roller 56 is formed by a metal rod (core metal) 56*a* on which a resistive layer and a surface layer are laminated. The metal rod is made stainless steel, aluminum, or the like. The resistive layer is formed of semi-conductive rubber. In this embodiment, the external diameter of the nip forming roller 56 is approximately 20 mm. The diameter of the metal rod is approximately 16 mm stainless steel. The resistive layer is formed of a friction rubber NBR/ECO having a degree of hardness from 40 to 60. The surface layer is formed of flurourethane elastomer having a thickness within 8 μm to 24 μm. As for the reason, the surface layer is manufactured by coating with the roller, as a result, when the thickness of the surface layer is thinner than 8 Ωm, the influence of the resistive unevenness caused by coating unevenness is great, which is not preferable because leakage may occur in an area in which the resistance is low. In addition, wrinkles may occur in the surface of the roller, which causes cracks in the surface layer.

By contrast, when the thickness of the surface layer is thicker than 24 μm, the resistance thereof is increased. Then, when the volume resistivity is high, the voltage when the constant current is applied to the metal core in the secondary transfer rear roller 53 may be increased. The voltage exceeds a voltage variable range in the secondary transfer power supply (constant-current power source) 200, and therefore, the current becomes less than the target current. Alternatively, when the voltage variable range is sufficiently high, a voltage in passage from the constant-current power source 200 to the metal core of the secondary transfer rear roller 53 and the voltage in the metal core of the secondary transfer rear roller 53 become high voltage, which causes current leakage. When the thickness of the nip forming roller 56 is thicker than 24 μm, the nip forming roller 56 becomes harder, and the adhesion to the recording media (sheet) and the intermediate transfer belt 51 deteriorates.

In the present embodiment, the surface resistivity of the nip forming roller 56 is over $10^{6.5}\Omega$ and the volume resistivity of the surface layer of the nip forming roller 56 is over $10^{10}$ Ωcm, preferably, over $10^{12}$ Ωcm.

Alternatively, the nip forming roller 56 has a surface layer that is made of unlaminated foamed material. In this configuration, the volume resistivity thereof is within a range of from 6.01 log Ωcm to 8.01 log Ωcm, preferably approximately, within a range from 7.01 log Ωcm to 8.01 log Ωcm. In this case, the secondary transfer rear roller 53 may be made of a foamed material, a rubber material, or a metal roller (e.g., stainless steel (SUS)). It is preferable that the volume resistivity of the secondary transfer rear roller 53 be lower than 7.01 log Ω that is lower than that of the nip forming roller 56. The volume resistivity of the secondary transfer rollers 53 and 56 are detected by rotational measurement, similarly to the primary transfer roller 55.

The electronic potential sensor 58 is provided inside the loop of the intermediate transfer belt 51, facing the loop of the intermediate transfer belt 51 around which the driving roller 52 is wound, and facing 4 mm gap. Then, when the toner image transferred onto the intermediate transfer belt 51 enters the portion facing the electronic potential sensor 58, the electronic potential sensor 58 measures the electronic potential of the surface thereof. Herein, EFS-22D, manufacture by TDK company, is used as the electronic potential sensor 58.

On the right side of the secondary transfer nip formed between the secondary-transfer rear roller 53 and the intermediate transfer belt 51, the fixing device 90 is disposed. The fixing device 90 includes a fixing roller 91 and a pressing roller 92. The fixing roller 91 includes a heat source such as a halogen lamp inside thereof. While rotating, the pressing roller 92 presses against the fixing roller 91, thereby forming a heated area called a fixing nip therebetween.

The recording medium P bearing an unfixed toner image on the surface thereof is conveyed to the fixing device 90 and interposed in a fixing nip between the fixing roller 91 and the pressing roller 92 in the fixing device 90. Under heat and pressure in the fixing nip, the toner adhered to the toner image is softened and fixed to the recording medium P. Subsequently, the recording medium P is discharged outside the image forming apparatus from the fixing device 90 along a sheet passage after fixing.

(Secondary Transfer Bias Power Supply)

The image forming apparatus includes the secondary transfer bias power supply 200. The secondary transfer bias power supply 200 includes a direct current (DC) voltage source 201 to output a direct current voltage and a superimposed voltage source 202 (AC+DC voltage source) to output a superimposed transfer bias voltage in which an alternating current (AC) voltage is superimposed on a direct current (DC) voltage. As a secondary transfer bias, the secondary transfer bias power supply 200 outputs a direct current transfer bias (hereinafter "DC bias") constituted by the direct current voltage and the superimposed transfer bias (hereinafter "superimposed bias") in which the AC voltage is superimposed on the DC voltage. The nip forming roller 56 and the secondary transfer rear roller 53 function as secondary transfer members.

Figure 3A:
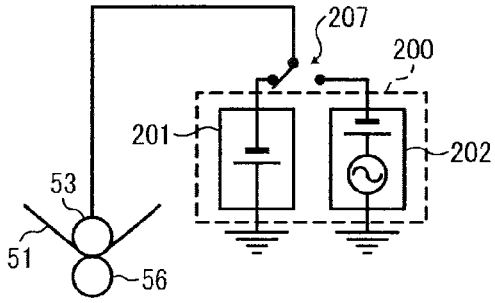
FIGS. 3A and 3B are schematic diagram illustrating secondary transfer members and a secondary transfer bias power supply.
Figure 3B:
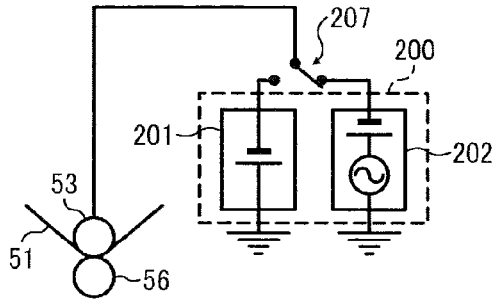

FIGS. 3A and 3B are schematic diagrams illustrating the secondary transfer members 53 and 56 and the secondary transfer bias power supply 200. In FIGS. 3A and 3B, the secondary transfer bias power supply 200 includes the DC voltage source 201, serving as a first power source, and the superimposed voltage source 202, serving as a second power source. The secondary transfer bias power supply 200 selectively switches between the DC bias and the superimposed bias for output to the secondary transfer members 53 and 56. It is to be noted that although in the present embodiment the superimposed voltage source 202 serves as the second power source, the second power source may be constituted by an AC voltage source 202B (see FIG. 11)

In FIGS. 3A and 3B, the secondary transfer bias power supply 200 is constituted by the DC voltage source 201 and the superimposed voltage source 202. In a state shown in FIG. 3A, the DC bias from the DC voltage source 201 is applied to the secondary transfer members. In a state shown in FIG. 3B, the superimposed bias from the superimposed voltage source 202 is applied to the secondary transfer members. FIGS. 3A and 3B conceptually illustrate the switching between the DC voltage source 201 and the superimposed voltage source 202, controlled by a switch 207. Relay switches (RELAY1, RELAY2, and RELAY illustrated in FIGS. 6 and 9) and a switching configuration, in which the applied voltages from the voltages sources 201A-1 and 202A-1 are stopped by the control signals from the controller 300 (see FIG. 11), can be used as specific configurations of the switch 207; which is described in further detail later.

Figure 4:
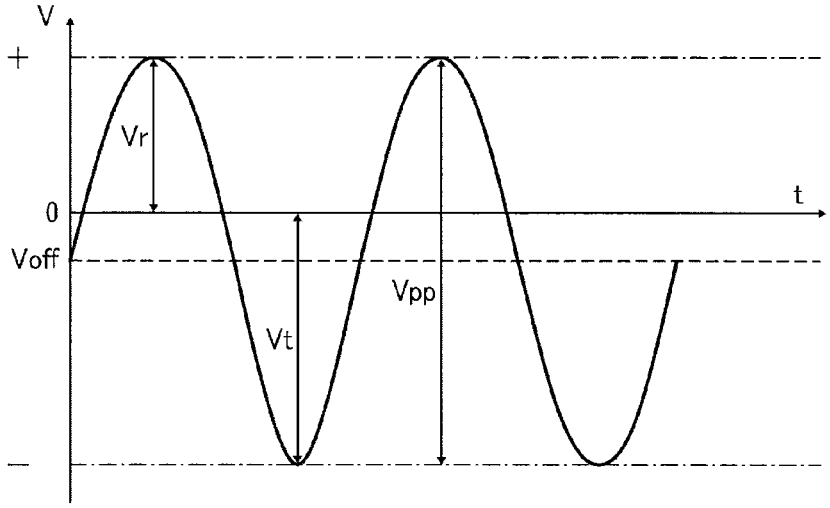
FIG. 4 is a waveform diagram illustrating a waveform of a superimposed bias output from a superimposed voltage source of the secondary transfer bias power supply shown in FIGS. 3A and 3B.

FIG. 4 is a waveform diagram illustrating a waveform of the superimposed bias output from the superimposed voltage source 202. In FIG. 4, an offset voltage Voff is a value of a direct current (DC) component of the superimposed bias. A peak-to-peak voltage Vpp is a peak-to-peak voltage of an alternating current (AC) component of the superimposed bias. The superimposed bias is a value in which the peak-to-peak voltage Vpp is superimposed on the offset voltage Voff. In FIG. 4, the superimposed bias is a sine waveform, having plus-side peak and minus-side peak. The minus-side peak is indicated by a value Vt, corresponding to a position at which the toner is moved from the belt side to the recording medium, in the secondary transfer nip. The plus-side peak is represented by a value Vr, corresponding to a position direction in which the toner is returned to the belt side (plus side).

By applying the superimposed bias including the alternating current (AC) and setting the offset voltage Voff (applied time-averaged value) to the same polarity as the toner, the toner is reciprocally moved and is relatively moved from the belt side to the recording medium. Thus, the toner is transferred on the recording medium. It is to be noted that although in the present embodiment a sine waveform is used as the alternating voltage in the present embodiment, alternatively a rectangular wave may be used as the alternating current voltage.

Figure 5:
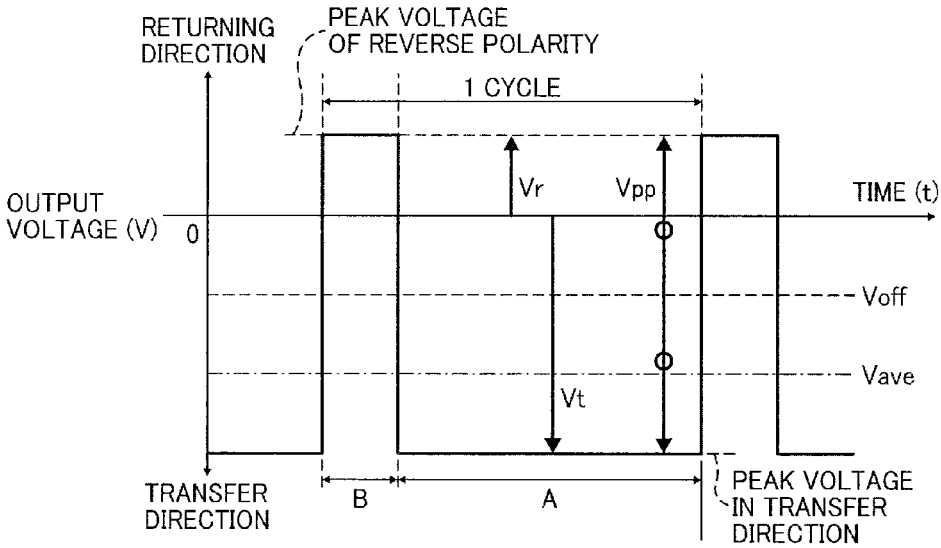
FIG. 5 is a waveform diagram illustrating another waveform of the superimposed bias output from the superimposed voltage source.

Herein, a time period during which the toner of the alternating-current component is moved from the belt side to the recording medium side (negative side), and the time period during which the toner is returned from the recording medium side to the belt side (positive side) can be set different time. As illustrated in FIG. 5, in one cycle in the alternating component, a time period A during which the toner is moved from the belt side to the recording medium side is set greater than a time period B during which the toner is returned from the recording medium to the belt side. Herein, the waveforms shown in FIGS. 4 and 5 are examples, any ratio of the time period A in the transfer direction to the time period B in the returning direction can be set.

In the present disclosure, the transfer mode is switched depending on the asperity of the recording medium. More specifically, when a rough sheet having large asperity (e.g., wavy Japanese paper, or an embossed sheet) is used as the recording medium, the toner image is transferred in the superimposed transfer mode. By applying the superimposed bias, while the toner is reciprocally moved and relatively moved from the belt side to the recording medium side to transfer the toner onto the recording medium. With this configuration, transfer performance to concave portions of the rough sheet can be improved, and entire transfer efficiency is improved, thereby preventing the formation of abnormal images, such as images with white spots in which the toner is not covered with the concave portion. By contrast, when a sheet having small asperity (e.g., normal transfer sheet) is used as the recording medium, sufficient transfer performance can be attained by applying secondary transfer bias consisting only of the direct current (DC) voltage.

Figure 6:
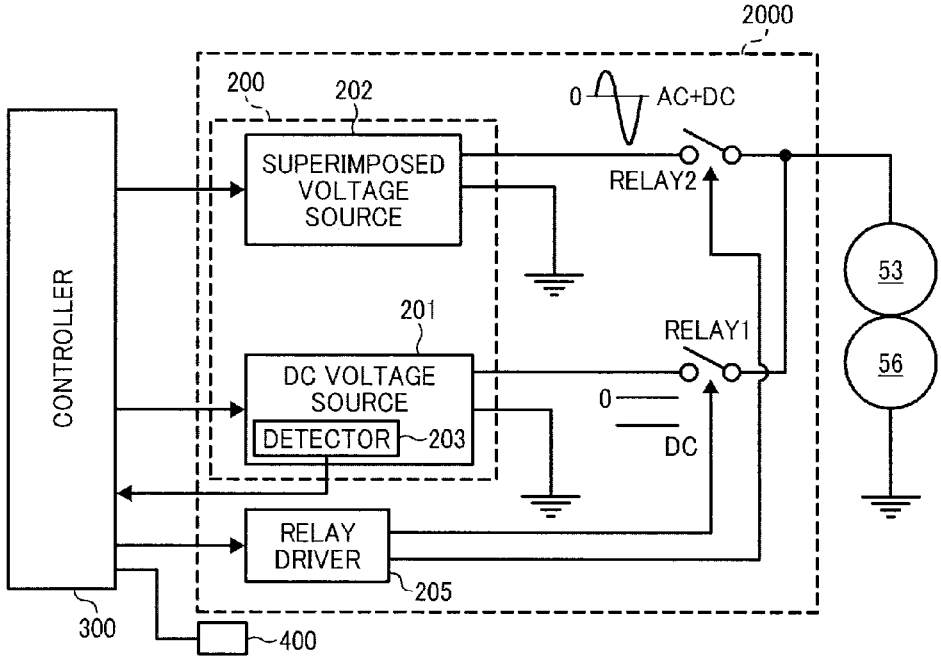
FIG. 6 is a block diagram illustrating a configuration of a secondary transfer bias applicator including a direct current voltage source and the superimposed voltage source.
Figure 7:
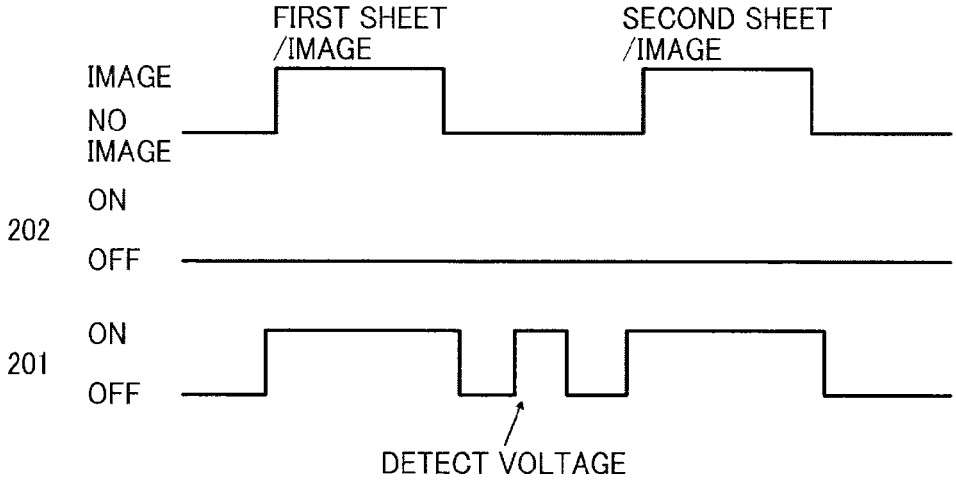
FIG. 7 is a timing chart illustrating control of the voltage sources during a direct current transfer mode.

FIG. 6 is a block diagram illustrating a configuration of a secondary transfer bias applicator 2000 including a secondary transfer bias power supply 200. In this configuration, using two relay switches RELAY1 and RELAY2, the voltage sources 201 and 202 to apply bias are switched. As illustrated in FIG. 6, in a first transfer mode, the DC voltage source (first power source) 201 applies the DC bias to the secondary transfer rear roller 53 via a DC relay switch RELAY1. In a second transfer mode, the superimposed voltage source (second power source) 202 applies the superimposed bias to the secondary transfer rear roller 53 via an AC relay switch RELAY2. In other words, the secondary transfer bias applicator 2000 includes the first relay RELAY1 through which the direct current transfer bias from which the direct current voltage source 201 is output and the second relay RELAY2 through which the superimposed current transfer bias from which the superimposed voltage source 202 is output. The relay switches RELAY1 and RELAY2 serve as mode switching elements. By controlling connection and disconnection of the relay switches RELAY1 and RELAY2 by a controller 300 via a relay driver 205, the DC bias or the superimposed bias is switched as the secondary transfer bias.

The controller 300 controls both the DC voltage source 201 and the superimposed voltage source 202. In the present embodiment, a voltage detector 203 is provided only the DC voltage source 201. The voltage detector 203 detects a feedback voltage for output to the controller 300 to calculate an electrical resistance of a transfer portion. The secondary transfer rear roller 53, the nip forming roller 56, the transfer belt 51, the passed recording medium are in the transfer portion.

Herein, the intermediate transfer member 51 serves as an image carrier to bear a toner image. The nip facing roller 56 serves as a facing member disposed opposite and facing the image carrier 51 (intermediate transfer) via a transfer position (transfer nip N). The transfer position at which the toner image is transferred on the recording medium from the image carrier 51 is positioned between the intermediate transfer belt 51 and the recording medium on the nip forming roller 56. The core metal 53*a* of the secondary transfer rear roller 53 serves as a first position, and the core metal 56*a* of the nip facing roller 56 serves as a second position. The secondary transfer bias power supply 200 outputs a voltage between the first position (core metal 53*a* of the secondary transfer rear roller 53) near the image carrier (intermediate transfer belt 51) side from the transfer position (transfer nip N) and the second position (core metal 56*a* of the nip facing roller 56) near the facing member (nip forming roller 56) side from the transfer position N. The voltage detector 203 serves as a resistance detector to detect an electrical resistance between the first position 53*a* and the second position 56*a* via the transfer position N. The controller 300 switches between the first transfer mode (first mode) in which the power supply 200 outputs the direct current voltage and the second transfer mode (second mode) in which the power supply 200 outputs the superimposed voltage in which an alternating current voltage is superimposed on a direct current voltage. When the toner image on the image carrier 51 is transferred on the recording medium at the transfer position, the controller 300 selects either the first mode or the second transfer mode. When the detector 203 detects the electrical resistance of the route, the controller 300 selects the first transfer mode.

In the present embodiment, in the DC transfer mode (first transfer mode) during which the DC bias is applied to the secondary transfer rear roller 53 as the secondary transfer bias to transfer the toner image on the recording medium, using the DC voltage source 201, the voltage detector 203 detects the feedback voltage. Then, the controller 300 calculates an electrical resistance of the transfer portion based on the feedback voltage to control a transfer current for the applied secondary transfer bias. The DC voltage source 201 is subjected to constant current control. In this embodiment, the voltage is detected per a predetermined number of outputs (after the toner is imaged on the predetermined number of the recording media); in other words, the voltage is detected in an interval between successive image forming operations.

FIG. 6 is a graph illustrating a voltage detection timing when the DC bias is applied (when the DC mode is selected). It is to be noted that, FIG. 6 illustrates the detection during the interval between the first sheet and the second sheet, as described above, the voltage is detected per a predetermined number of output (transfer). Herein, although the voltage detector 203 detects the voltage in the interval between successive image forming operations, the voltage detector 203 detects the voltage after the successive image forming operations. In FIG. 6, when the voltage is detected, the output of the DC source 201 is off state, if it not necessary to turn off, the voltage can be detected by decreasing the output in part (changing the monitor voltage).

By contrast, in the superimposed transfer mode (second transfer mode) during which the superimposed bias is applied to transfer the toner image as the secondary transfer bias, because the superimposed voltage source 202 does not include a voltage detection device 203, the output voltage is detected using the DC voltage source 201, thus, the resistance of the secondary transfer portion (route) is calculated, and the output of the superimposed voltage source 202 is corrected (controlled). It is to be noted that the voltage detector 203 detects the voltage per the predetermined number of the output (transfer).

Figure 8:
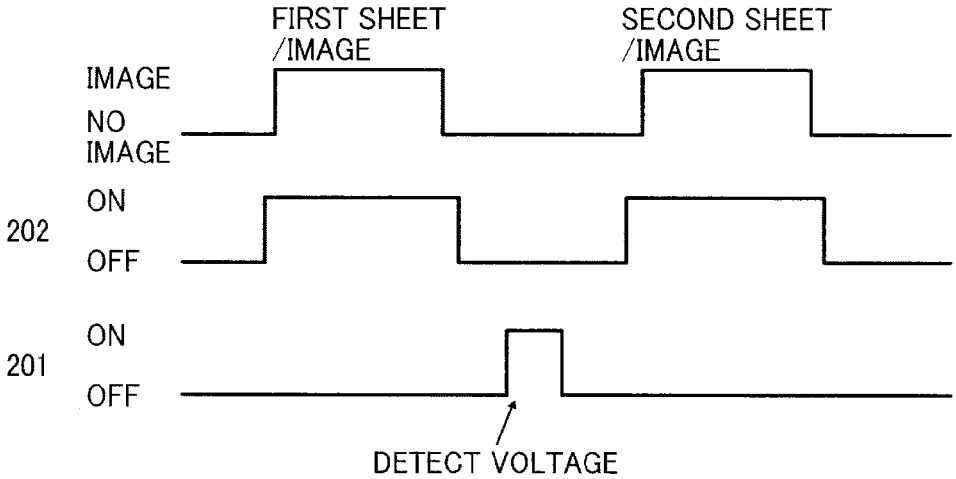
FIG. 8 is a timing chart illustrating control of the voltage sources during a superimposed bias transfer mode.

FIG. 8 is a graph illustrating the voltage detection timing when the AC DC superimposed bias (or AC bias) is applied. In FIG. 8, the voltage detector 203 detects the voltage in the interval between the first sheet and the second sheet, however, as described above, the voltage detector 203 detects the voltage per the predetermined number of the output (transfer). Herein, the voltage is detected in an interval between successive image forming operations (interval between the sheets) in FIG. 7, the voltage may be detected after the successive image forming operations. As is clear from the timing chart shown in FIG. 8, while the output voltage is detected using the voltage detector 203 in the DC voltage source 201, the superimposed voltage source 202 is off and the DC voltage source 201 is on. That is, in the superimposed transfer mode, while the power supply 200 is temporarily switched from the superimposed voltage source 202 to the DC voltage source 201, the output voltage (the resistance of the transfer portion) is detected. The voltage detector 203 can detect the electrical resistance of the transfer portion without affecting from the output from the superimposed voltage source 202, by turning off the superimposed voltage source 202 when the output voltage is detected during the superimposed transfer mode.

In the present embodiment, the controller 300 corrects the output of the power supply 200 based on the detection result of the electrical resistance of the transfer portion. More specifically, when the resistance is high, the controller 300 adjusts the power supply 200 so that the output of the power supply 200 is increased, when the resistance is low, the controller 300 adjusts the power supply 200 so that the output of the power supply 200 is decreased. By detecting the resistance of the transfer portion per the predetermined number of sheet and adjusting the output of the power supply 200, preferable transfer performance can be kept over time.

As described above, in the power supply 200 including the DC voltage source 201 and the superimposed voltage source 202 as a secondary transfer bias applying power source, although the superimposed voltage source 202 does not include a voltage detector to detect a feedback voltage, the controller 300 can detect the electrical resistance in the secondary transfer portion in the superimposed transfer mode in which the superimposed transfer bias is applied, so the superimposed bias can be applied at a suitable transfer current.

Accordingly, the preferable image transfer can be performed based on the suitable amount of the superimposed bias, with achievement of reducing space of the superimposed voltage source 202 and reducing cost. More specifically, the preferable image transfer can be performed using the superimposed transfer bias for a large-asperity recording medium. On the other hand, the preferable image transfer can be performed using the DC transfer bias for a small-asperity recording medium. Thus, by switching the DC transfer mode and the superimposed transfer mode, the preferable image transfer can be performed for various types of recording media. In addition, since the voltage can be detected both when the DC bias is applied and the superimposed bias is applied to calculate the resistance in the transfer members, the controller 300 can control the transfer bias at a suitable transfer current in accordance with the resistance that changes with ambient condition.

It is to be noted that, when the DC bias is applied and the AC bias is applied, although the voltage detector 203 detects the voltage during printing, the detection timing is not limited above. For example, the voltage detector 203 may detect, for example, in a time interval between a first sheet (former sheet) and a second sheet (following sheet), after the predetermined number of sheet are printed (successive image forming operation), when the image forming apparatus 1000 starts up, and before adjustment of image forming conditions.

An ambient condition detector 400 to detect ambient conditions including at least one of a temperature, a relative humidity in the image forming apparatus 1000 is provided in the image forming apparatus 100. The ambient condition detector 400 detects changes in the ambient conditions by selecting one from the temperature, the relative humidity, and an absolute humidity calculated from the temperature and the relative humidity or by combining at least two of the temperature, the relative humidity, and the absolute humidity. Thus, the voltage detector 202 detects the electrical resistance of the transfer portion based on the detection result of the ambient condition detector 400. For example, when the change in the ambient condition exceeds a specified value (for example, the temperature change 5° C.), the voltage detector 203 detects the voltage (resistance).

Alternatively, the controller 300 may correct (adjust) the transfer bias to be applied to the secondary transfer portion based on the detection result of the ambient condition detector 400 in addition to the feed back voltage detection data (resistance) detected in the DC transfer is applied and the superimposed bias is applied. In this configuration, when the temperature is low, the controller 300 corrects the output (applying bias) of the power supply 200 to be greater, and when the temperature is low, when the controller 300 corrects the output (applying bias) of the power supply 200 to be smaller. Similarly to the temperature, same correction can be performed for detecting result of the humidity. Thus, preferable transfer performance can be achieved in accordance with the ambient condition.

Yet alternatively, the controller 300 can control the secondary transfer bias in the power supply 200 in accordance with a size of the recording medium. In this correction, when the paper size is small, the controller 300 corrects the output from the power source 200 to be greater. When the paper size is small, the controller 300 corrects the output from the power source 200 to be greater. Accordingly, preferable transfer performance can be achieved in accordance with the paper size.

(Variation 1 of Power Supply)

Figure 9:
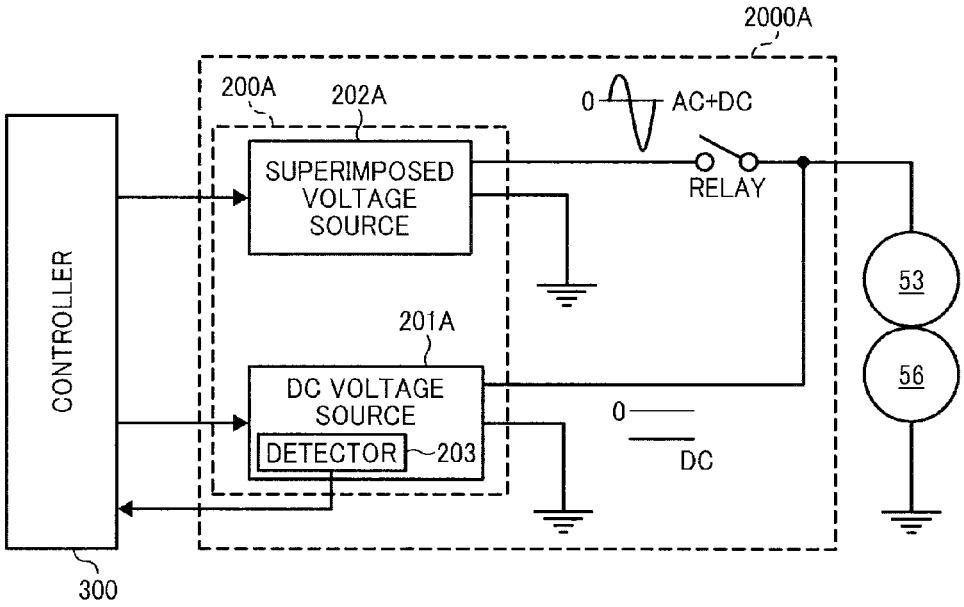
FIG. 9 is a block diagram illustrating another configuration of a secondary bias applicator including the direct current voltage source and a superimposed voltage source.

FIG. 9 is a block diagram illustrating a variation of a secondary transfer bias applicator 2000A. In this variation, the power source 200A is switched by using a single relay. With this configuration, a relay switch is only provided for the output of the superimposed voltage source 202A. When a superimposed voltage source 202A outputs the superimposed voltage by connecting a contact point of the relay switch, the voltage is also applied to the DC voltage source 201A connected in parallel to the superimposed voltage source 202A. Therefore, although the DC voltage source 201A serves as a load to the superimposed voltage source 202A, in a case in which the transfer portion is not affected from the current supplied to the DC voltage source 201A, this configuration is a simple configuration, thereby reducing manufacturing cost by achieving same function with a simple configuration.

(Variation 2 of Power Supply)

Figure 10:
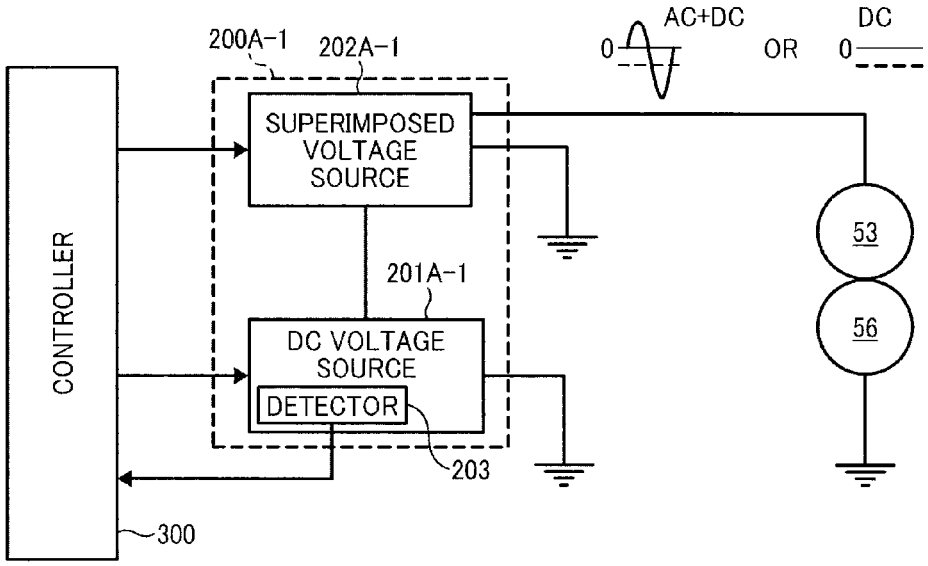
FIG. 10 is a block diagram illustrating yet another configuration of a secondary bias applicator including a direct current voltage source and a superimposed voltage source.

FIG. 10 is a block diagram illustrating a secondary transfer bias power supply 200A-1 that is not connected to a switch. In FIG. 10, when the superimposed bias is output, the controller 300 outputs an output signal to the DC voltage source 201A-1 and the AC voltage source 202A-1, and the superimposed bias is applied to the secondary transfer rear roller 53. When the DC bias is output, the controller 300 outputs the output signal only to the DC voltage source 201A-1, the superimposed bias is applied to the secondary transfer rear roller 53. In this configuration, since the voltage detector (feedback voltage detector) 203 is provided in the DC voltage source 201A-1, the voltage can be detected in a state in which the superimposed voltage source 202A-1 is off state by inputting an output signal (control signal) only to the DC power voltage source 201A-1 from the controller 300. Accordingly, the function can be achieved with uncomplicated configuration, thereby reducing cost.

In above-described embodiment, although the secondary transfer bias is applied to the secondary transfer rear roller 53, the present disclosure is not limited above, the secondary transfer bias can be applied to the nip forming roller 56 (facing roller) and the secondary transfer rear roller 53 is electrically grounded. In this case, the polarity of the DC voltage is changed. That is, in a configuration in which the secondary transfer bias is applied to the secondary transfer rear roller 53, the secondary transfer rear roller 53 functions as repulsive roller. By contrast, in a configuration in which the secondary transfer bias is applied to the nip forming roller 56 (facing roller), the secondary transfer rear roller 53 function as an attractive roller.

(Second Embodiment)

Figure 11:
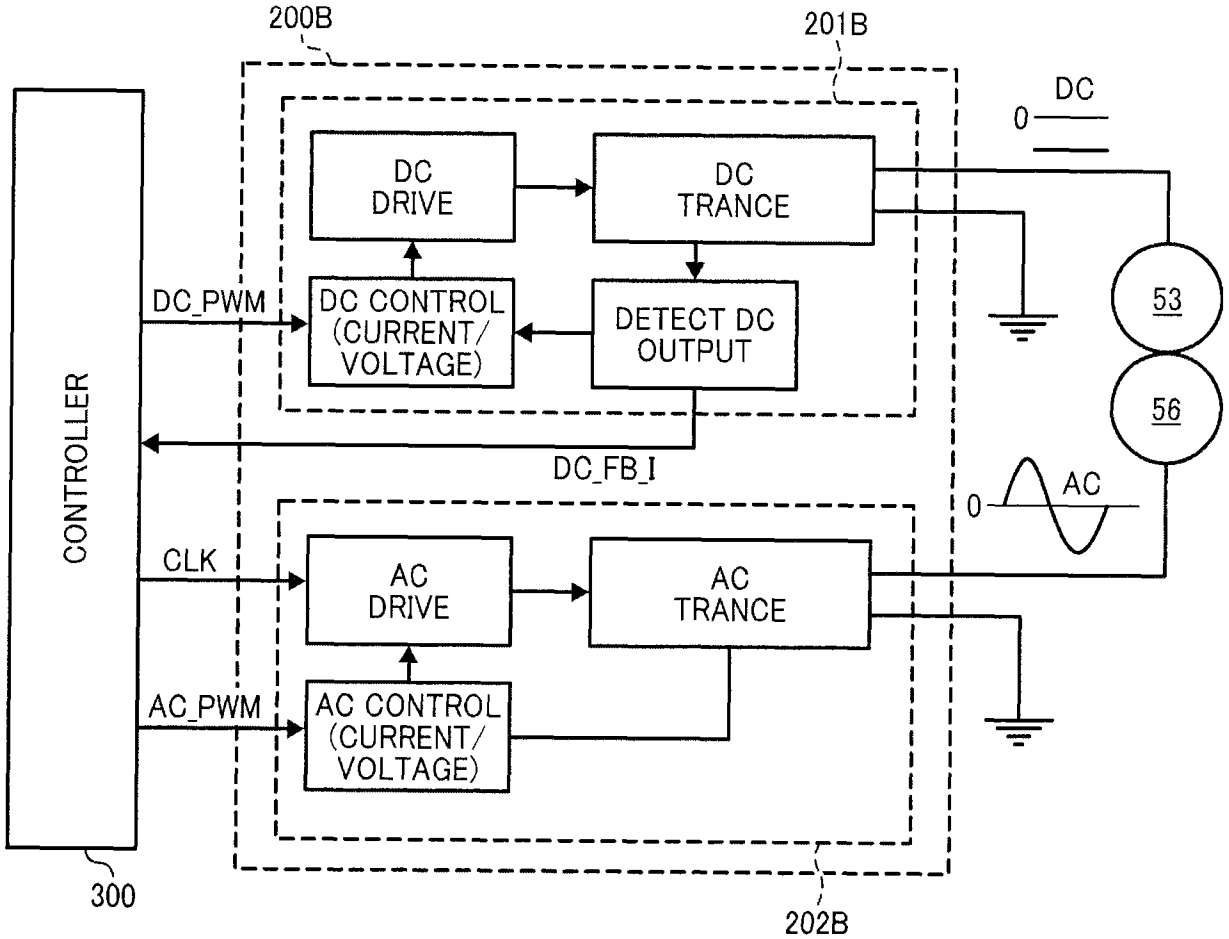
FIG. 11 is a block diagram illustrating a configuration of a secondary bias applicator including a direct current voltage source and an alternating current voltage source according to a second embodiment.

Further, when the superimposed bias is applied, the DC voltage may be applied to one of the secondary transfer rollers 53 and 56, and the AC voltage may be applied to the other of the secondary transfer rollers 53 and 56. FIG. 11 is a block diagram illustrating the configuration of a secondary transfer bias power supply 200B of a second embodiment. It is to be noted that, for ease of explanation and illustration, because other than the difference described above the secondary transfer power supply 200 B the has a configuration similar to the configuration of the secondary transfer bias power supply 200 in the first embodiment, other components of the secondary transfer bias power supply 200B are represented by identical numerals and the description thereof is omitted below.

In FIG. 11, the secondary transfer bias power supply 200B includes a DC voltage source 201B to output the DC voltage and an alternating current (AC) voltage source 202B to output an alternating-current (AC) voltage. The DC voltage source 201B serves as the first power source, the AC voltage source 202B servers as the second power source. The DC voltage from the DC voltage source 201B is applied to the secondary transfer rear roller 53, and the AC voltage from the AC voltage source 202B is applied to the nip forming roller 56 (facing roller).

The DC voltage source 201B includes a DC controller 2011, a DC driver 2012, a DC high-voltage trance 2013, and a DC output detector 2014. The AC voltage source 202-B includes an AC controller 2021, an AC driver 2022, and an AC high-voltage trance 2023. The controller 300 supplies a control signal DC_PWM to set a current or voltage of the DC output of the DC voltage source 201, and the DC voltage source 201 outputs a monitor signal DC_FB that monitors the DC output to the controller 300.

The controller 300 supplies a clock signal CLK that sets a frequency of AC voltage to the AC voltage source 202B and a control signal AC_PWM to set a current or voltage of the AC output of the AC voltage source 202B. The DC controller 2011 outputs drive control signal to control the DC high-voltage trance 2013 via the DC driver 2012 based on a command from the controller 300. The AC controller 2021 outputs drive control signal to control the AC high-voltage trance 2023 via the AC driver 2022 based on a command from the controller 300.

In the second embodiment, when the DC bias is applied as the secondary transfer bias, the power supply 200B uses only the DC voltage source 201B to apply the DC bias to the secondary transfer rear roller 53. By contrast, when the AC bias is applied as the secondary transfer bias, the power supply 200B uses both the DC voltage source 201B to apply the DC bias to the secondary transfer rear roller 53 and the AC voltage source 202B to apply the AC bias to the nip forming roller 56. Thus, the controller 300 can switch between the secondary transfer using only the DC voltage and the secondary transfer using the superimposed voltage in which the AC voltage output from the AC voltage source 202B is superimposed on the DC voltage output from the DC voltage source 201B.

It is to be noted that the DC bias may be applied to the nip forming roller 56 and the AC bias may be applied to the secondary transfer rear roller 53. In this case, the polarity of the DC voltage is changed.

In the second embodiment, in the superimposed transfer mode in which the superimposed bias is applied to transfer the toner image as the secondary transfer bias, the DC voltage source 201B detects the output voltage and the feedback. Thus, the resistance value in the secondary transfer portion is calculated, and the output of the AC voltage source 202B is controlled (corrected). In addition, in the DC transfer mode, by detecting and feeding back the output voltage, the resistance value in the secondary transfer portion is calculated, and the output of the AC voltage source 202B is controlled (corrected).

It is to be noted that, when the DC bias is applied and the AC bias is applied, although the voltage detector 203 detects the voltage during printing, the detection timing is not limited above. For example, the voltage detector 203 may detect, for example, in a time interval between a first sheet (former sheet) and a second sheet (following sheet), after the predetermined number of sheet are printed (successive image forming operation), when the image forming apparatus 1000 starts up, and before adjustment of the image forming conditions.

(Variation of Second Embodiment)

As a variation of the power supply 200B, a controller 300 may switch between a direct current transfer mode in which the direct current transfer bias is applied to transfer the toner image and an alternating current transfer mode in which the alternating transfer bias is applied to transfer the toner image while the direct current voltage source and the alternating current voltage source are off.

However, the superimposed transfer mode is preferable to the AC transfer mode in view of the transfer performance in the concave portion in the recording medium.

Herein, variations of the transfer units and the image forming apparatuses are described below with reference to FIGS. 12 through 19.

In below described variations, similarly to above-described embodiments, in a case in which the electrical resistance of the transfer portion is detected when the superimposed bias is applied, the voltage detector 203 in the DC voltage source 201 detects the DC voltage for feeding back to the controller 300 as the feedback voltage, and the controller 300 calculates electrical resistance in the transfer portion to correct the output of the superimposed voltage source 202. In addition, as for the detection timing, the voltage detector 203 may detect, for example, in a time interval between a first sheet (former sheet) and a second sheet (following sheet), after the predetermined number of sheet are printed (successive image forming operation), when the image forming apparatus 1000 starts up, and before adjustment of image forming conditions.

Thus, the image forming apparatuses according to below described variations shown in FIGS. 12 through 19 can achieve effects similar to those of the image forming apparatus 1000 described above.

(Variation 1: Intermediate Transfer Type)

Figure 12:
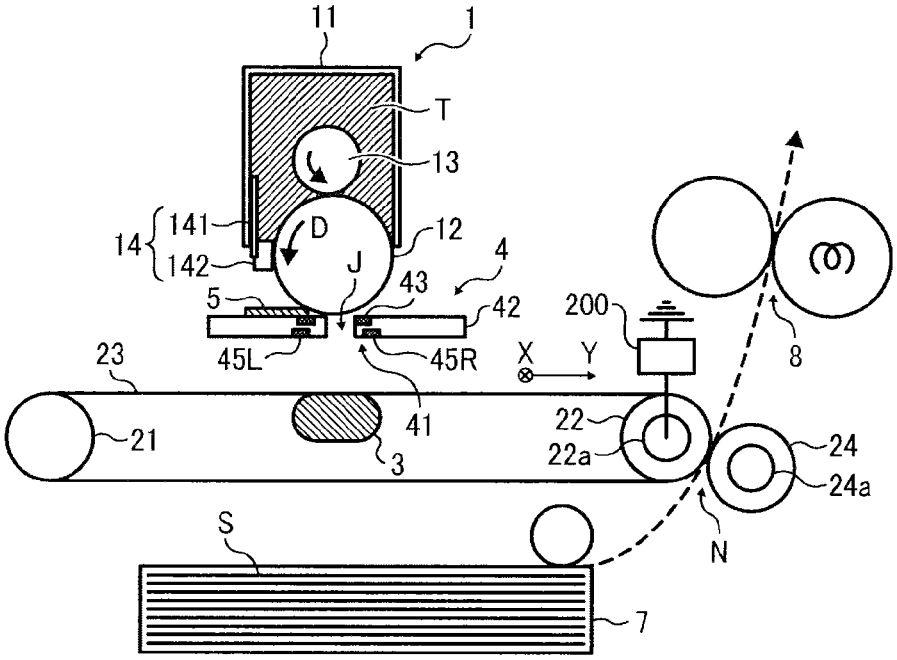
FIG. 12 is a schematic diagram illustrating a toner-jet type image forming apparatus.

FIG. 12 is a schematic diagram illustrating an image forming unit in a toner-jet type image forming apparatus using intermediate transfer. In the image forming apparatus illustrated in FIG. 12, the image is formed by jetting toner onto an intermediate transfer belt 23, and the image is transferred on the recording medium in a transfer position. In this toner jetting type color image forming apparatus, as a power source to apply the transfer bias to respective transfer members 22 and 24, the DC power source to apply the DC bias and the superimposed power source to apply the superimposed bias are provided. The secondary transfer bias can be applied while switching the DC bias and the superimposed bias.

In this variation, the intermediate transfer belt 23 serves as the image carrier, the secondary transfer roller 24 serves as the facing member. In addition, a core metal 22*a* of the secondary transfer rear roller 22 serves as the first position, and a core metal of the secondary transfer roller 24 serves as the second position.

(Variation 2)

Figure 13:
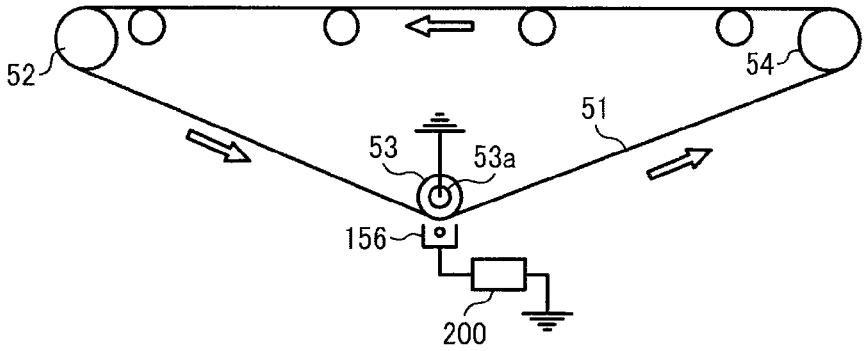
FIG. 13 is a schematic diagram illustrating a secondary transfer unit using a secondary transfer charger.

FIG. 13 is a schematic diagram illustrating a secondary transfer member according to a second variation. As illustrated in FIG. 13, in the second variation, a transfer charger 156 as a non-contact type transfer member faces the secondary transfer rear roller 53 around which the intermediate transfer belt 51 is wound. The secondary transfer bias power supply 200 applies the DC bias and the superimposed bias while switching to the transfer charger 156 while switching between the DC bias and the superimposed bias. As for the secondary transfer bias power source, the secondary transfer bias power supplies 200 through 200B according to the above-described embodiments can be adopted.

It is to be noted that, in the second embodiment, the polarity of the DC component of the transfer bias applied to the transfer charger 156 is opposite to the polarity of the toner charging polarity. The transfer bias is transferred on the sheet passes between the transfer rear roller 53 and the transfer charger 156 via the intermediate transfer belt 51 by sucking.

In this variation, the intermediate transfer belt 51 serves as the image carrier, the secondary transfer charger 156 serves as the facing member. In addition, a core metal 53*a* of the secondary transfer rear roller 53 serves as the first position, and the secondary transfer charger 156 serves as the second position.

(Variation 3)

Figure 14:
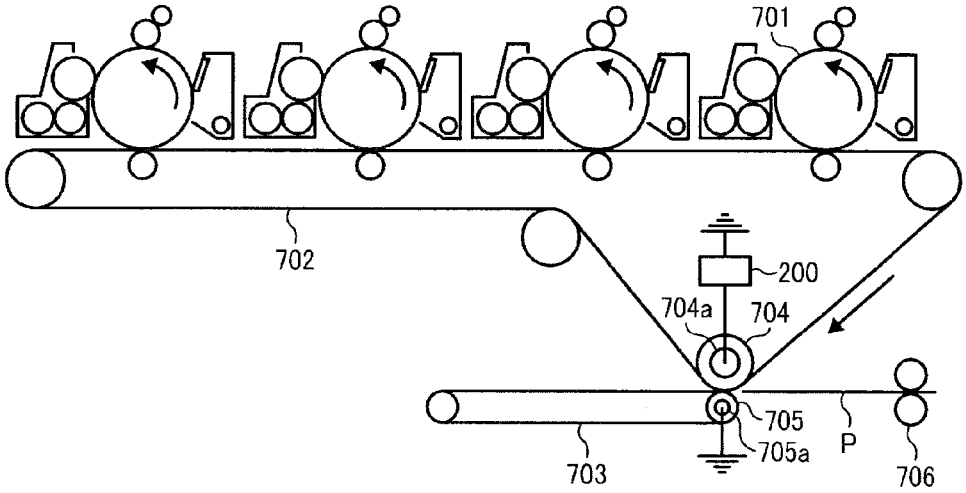
FIG. 14 is a schematic diagram illustrating a secondary transfer unit using a secondary transfer belt in single drum photoconductor type image forming apparatus.

FIG. 14 is schematic diagram illustrating a transport portion according to a variation. In FIG. 14, a secondary transport-transfer belt 703 contacts a transfer belt 702 (intermediate transfer body), thereby forming a secondary transfer nip, and the image is transferred onto the recording medium P in the secondary transfer nip. After that, the recording medium P is transported by the secondary transport-transfer belt 703. More specifically, after the recording medium P is sent from a registration roller pair 706, while the recording medium P passing through the secondary transfer nip in which the secondary transport-transfer belt 703 and the intermediate transfer belt 702 are pressed each other, the image is transferred on the recording medium P. Then the recording medium P separated from the intermediate transfer belt 702 is transported by the secondary transport-transfer belt 703 to a fixing device (not shown).

In a repulsion transfer, a rear roller 704 on the intermediate transfer belt 702 side, constituting the secondary transfer nip, functions as a bias apply roller. In this case, a bias having a polarity opposite to the toner charging polarity (normal charging polarity) is applied to the rear roller 704. Alternatively, in an attraction transfer, a facing roller 705 on the secondary transfer-transport belt 703 side, constituting the secondary transfer nip, functions as a bias applying roller. In this case, a bias having a polarity identical to the toner charging polarity (normal charging polarity) is applied to the facing roller 705. Both repulsive transfer type and attractive transfer type is adaptable in the present variation.

Yet alternatively, a small bias applying brush and a small bias apply roller may be further provided inside the secondary transfer-transport belt 703 in addition to the facing roller 705. In this case, a transfer bias is applied to both or either the bias applying roller and/or the bias apply brush. The bias applying brush and the bias apply are disposed adjacent to the facing roller 705 and is provided inside loop of the secondary transfer belt 703. The transfer roller (facing roller 703, rear roller 704, bias apply roller) may contain a foamed layer (elastic layer) or may a coated surface layer. Yet alternatively, the transfer charger may be used as the transfer roller.

In this variation, the intermediate transfer belt 702 serves as the image carrier, the secondary transfer-transport belt 703 serves as the facing member. In addition, a core metal 704*a* of the rear roller 704 serves as the first position, and a core metal 705*a* of the facing roller 705 serves as the second position.

It is to be noted that, in a configuration in which the bias applying brush and the bias apply roller may be further provided inside the secondary transfer-transport belt 703, a metal core of the bias apply roller and/or and a plate of the bias applying brush serves as the second position.

(Variation 4)

Figure 15:
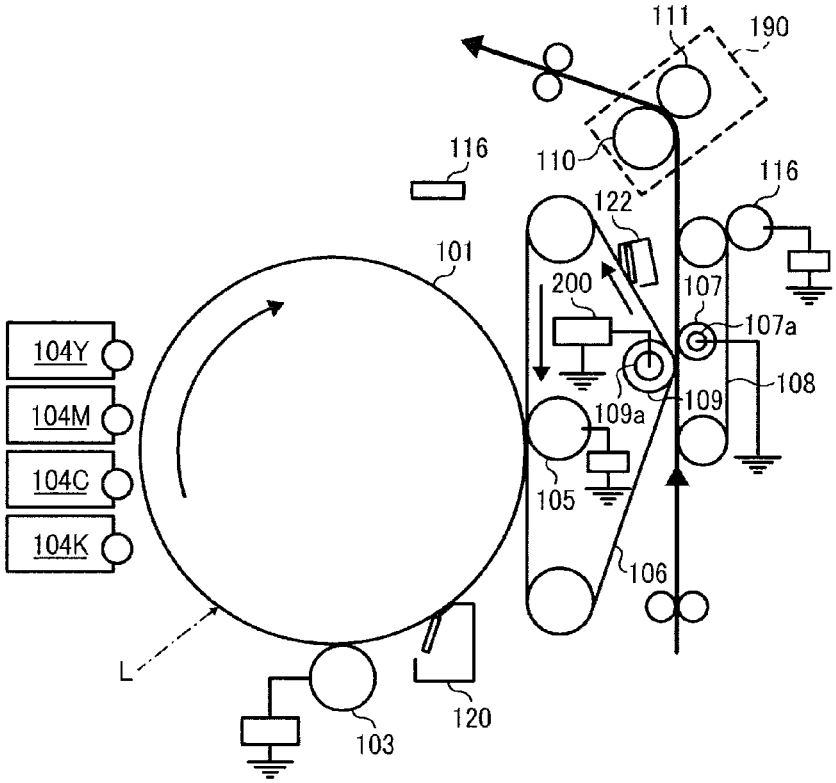
FIG. 15 is a schematic diagram illustrating a secondary transfer unit using a secondary transfer belt in for drum photoconductor type image forming apparatus.

In addition, as illustrated in FIG. 15, the present disclosure can be adopted for so-called a single drum type color image forming apparatus. In this single drum type color image forming apparatus, a charging member 103, four development unit 104Y, 104C, 104M and 104K corresponding to respective yellow, cyan, magenta, and black. In this configuration, when the image is formed, initially, the charging member 103 uniformly charges the surfaces of the photoconductor 101, then, the modulated laser beam L by Y image data is irradiated to the surface of the photoconductors 101, which forms electrostatic latent image for yellow on the surface of the photoconductor 101. Then, the development unit 104Y develops the electrostatic latent image for yellow. The Y toner image thus formed is primarily transferred on the intermediate transfer belt 106. After the residual toner after transfer on the surface of the photoconductor 101 is removed by the cleaning device 120, the charging device 103 uniformly charges the surface of the photoconductor 101. Subsequently, the modulated laser beam L by Y image data is irradiated to the surface of the photoconductors 101, which forms electrostatic latent image for yellow on the surface of the photoconductor 101. Subsequently, the development unit 104Y develops the electrostatic latent image for yellow The Y toner image thus formed is primarily transferred on the intermediate transfer belt 106. Then, for cyan and black, similarly the C and K toner images are primary transferred. Thus, the respective toner images on the intermediate transfer belt 106 are transferred on the recording medium transported to the secondary transfer nip.

The recording medium on which the toner image is transferred is transported to the fixing unit 190. The toner image on the recording medium is fixed on the recording medium with heat and pressure in the fixing unit 190. The recording medium after fixing is discharged to the discharge tray.

In this single-drum type color image forming apparatus, as a power source to apply the transfer bias to the respective transfer members, the DC power source to apply the DC bias and the superimposed power source to apply the superimposed bias are provided. The secondary transfer bias can be applied while switching the DC bias and the superimposed bias. While the transfer bias is switched, as described above, the transfer mode is switched in a state in which the DC voltage source 201 and the superimposed voltage source 202 are off, the configuration of the third embodiment can achieve effects similar to those of the image forming apparatus described above.

In this variation, the intermediate transfer belt 106 serves as the image carrier, the secondary transfer belt 108 serves as the facing member, a core metal 109*a* of the secondary transfer rear roller 109 serves as the first position, and a core metal 107*a* of the secondary transfer roller 107 serves as a second position.

(Variations: Direct Transfer Type)

Herein, although the above-described secondary transfer member and control system is not limited to intermediate transfer type the image forming apparatus, for example, as illustrated in FIGS. 16 through 19, the above-described secondary transfer member and the control in the secondary transfer bias power supplies 200 through 200B can be adopted in the direct transfer type image forming apparatus in which the toner image on the photoconductor is directly transferred on the recording medium. In these variations, a transfer roller and transfer belt serves as a facing member to face the image carrier (photoconductor) via a transfer position at which the toner image is transferred on the recording medium from the image carrier.

(Variation 5)

Figure 16:
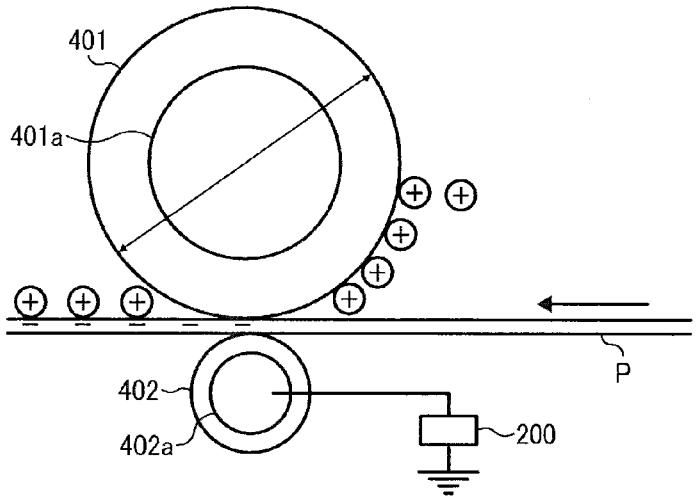
FIG. 16 is an expanded schematic diagram illustrating a transfer member and a photoconductor in a direct transfer-type and single drum photoconductor-type image forming apparatus.

FIG. 16 is expanded diagram illustrating the transfer portion in the direct transfer type. In FIG. 16, a photoconductor 401 directly contacts a transfer roller 402 having middle resistance. A transfer bias is applied to the transfer roller 402 to transfer the toner image onto the recording medium P while the recording medium P is transported. Although the photoconductor 401 is not limited to drum shaped, a belt shape can be adopted for the photoconductor 401. The transfer roller 402 may contain a foamed layer (elastic layer) or may a coated surface layer.

In the fifth variation, the photoconductor 401 serves as the image carrier, and the transfer roller 402 serves as the facing member. An inner surface 401*a* of the photoconductor 401 serves as the first position, and a core metal 402*a* of the transfer roller 402 serves as the second position.

(Variation 6)

Figure 17:
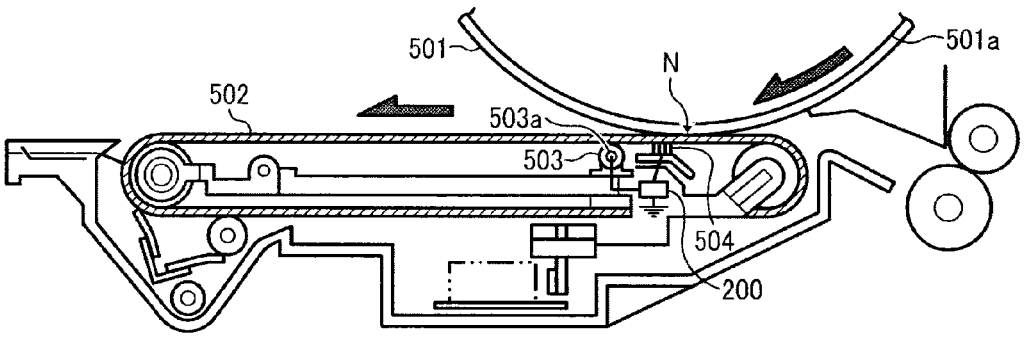
FIG. 17 is a schematic diagram illustrating a secondary transfer unit using secondary brushes in a direct-transfer type and single drum photoconductor type image forming apparatus.

FIG. 17 is a schematic diagram illustrating the transfer portion in the direct transfer type. In FIG. 17, a photoconductor 501 directly contacts a transfer-transport belt 502 having middle resistance. A transfer bias is applied to the transfer-transfer belt 502 to transfer the toner image onto the recording medium P while the recording medium P is transported. The transfer bias is applied to a transfer bias roller 503 and a bias applying brush 504 positioned inside loop of the transfer-transport belt 502. The transfer bias roller 503 and the bias applying brush 504 are connected to the high-voltage power supply 200.

Although the photoconductor 501 is not limited to drum shaped, the durum shaped can be adopted for the photoconductor 501. The transfer bias roller 503 may contain a foamed layer (elastic layer) or may a coated surface layer.

In the configuration shown in FIG. 17, the transfer bias roller 503 and the bias applying brush 504 are used as the bias applying members, the bias applying members are formed by both rollers or both brushes. In addition, as the arrangement position of the bias applying member, the transfer bias roller 503 and the bias applying brush 504 may be disposed directly under the transfer nip N. Alternatively, a single bias applying member may be provided in the present configuration. In this case, the bias applying member may be formed by either roller or brush. In a configuration in which a single bias applying member is provided, the bias applying member is position adjacent to the transfer nip (see FIG. 17), or directly under the transfer nip N. In addition, a non-contact type bias applying member (charger) may be used as the bias applying member; in this case, the charger is provided inside the loop of the transfer-transport belt 502.

In this variation, the drum-shaped photoconductor 501 is the image carrier, the transfer-transport belt 502 serves as the facing member. An inner surface 501*a* of the photoconductor 501 serves as the first position, and a core metal 503*a* of the transfer bias roller 503 and a core plate of the applying brush 504 serve as the second positions.

(Variation 7)

Figure 18:
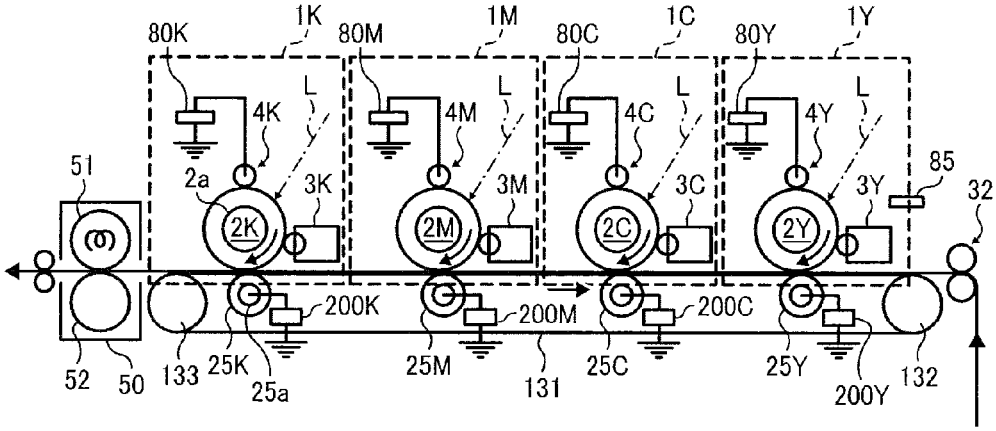
FIG. 18 is a schematic diagram illustrating a secondary transfer unit in a direct-transfer type and tandem drum photoconductors type image forming apparatus.

FIG. 18 is a schematic diagram illustrating the transfer unit in the direct transfer type. In this direct transfer type of the color printer, the recording medium is sent to the transfer belt 131 by a feeding roller 32, respective color images are sequentially directly transferred from respective photoconductive drums 2Y, 2M, 2C, and 2K onto the recording medium, and then the image are fixed by the fixing device 50.

Figure 19:
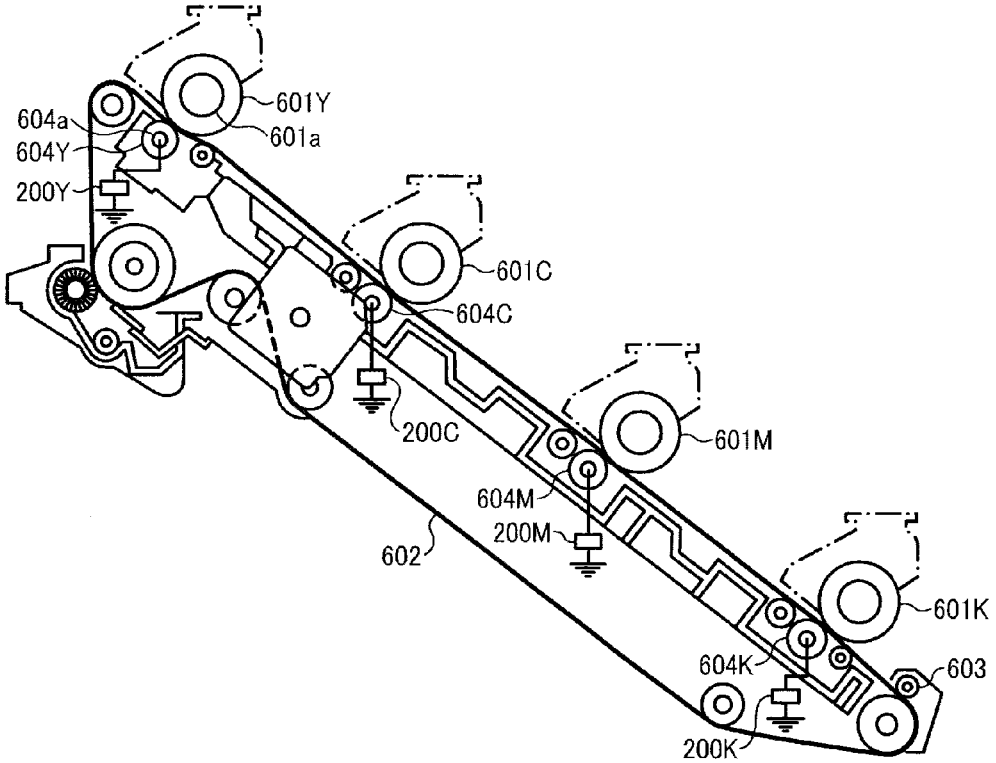
FIG. 19 is a schematic diagram illustrating another type of secondary transfer unit in a direct-transfer type and tandem drum photoconductors type image forming apparatus.

In another type of FIG. 18, FIG. 19 is a schematic diagram illustrating the transfer unit in the direct transfer type. In FIG. 19, similarly to FIG. 18, multiple photoconductors 601 contact the transfer-transport belt 602. A sheet suction roller 603 to which a predetermined bias voltage (sheet suction bias) is applied is provided in an entrance of the transfer-transport belt 602 (lower right in FIG. 18). The recording medium P passes beneath the sheet suction roller 603 and is sent to the belt 602. Then, while the recording medium P is electrostatically attracted on the belt 602, respective color toners are directly transferred on the recording medium P by the transfer rollers 604 corresponding to the photoconductors 601.

In the configuration shown in FIG. 19, the four high-voltage power supplies 200Y, 200C, 200M, and 200K connected to the four transfer rollers 604Y, 604C, 604M, and 604K apply the transfer bias to the four transfer rollers 604Y, 604C, 604M, and 604K corresponding to the photoconductors 601Y, 601C, 601M and 601K. Alternatively, t a single high-voltage power supply 200 may apply a transfer bias to the four transfer rollers 604. Alternatively, the bias applying brush may be provided instead of the transfer roller 604. Yet alternatively, both transfer roller and bias applying brush may be provided.

The bias applying brush and the bias apply are disposed adjacent to the facing roller 705 and is provided inside loop of the secondary transfer belt 703 (see FIG. 17). The transfer roller (facing roller 703, rear roller 704, bias apply roller) may contain a foamed layer (elastic layer) or may a coated surface layer.

In this variation shown in FIGS. 18 and 19, the drum-shaped photoconductors 2Y, 2M, 2C, and 2K (601Y, 601C, 601M, and 601K) serve as the image carriers, and the transfer-transport belt 131 (602) serves as the facing member. In addition, the inner face 2*a* of the photoconductors 2 (601) serve as the first positions, and the core metals 2*a* of the transfer rollers 25Y, 25M, 25C, and 25K (64Y, 64C, 64M, and 64K) serve as the second positions.

In addition, the material and shape of the power supply are not limited to the above-described embodiments, and various modifications and improvements in the configuration of the power supply are possible without departing from the spirit and scope of the present invention.

In addition, the configuration of the image forming apparatus and arrangement order of the image forming unit may be varied arbitrary. Alternatively, although the image forming apparatus is not limited to the four color images, for example, the image forming apparatus 100 may be a monochrome image forming apparatus, or color image forming apparatus using full color using three-color or two-color image.

It is to be noted that the configuration of the present specification is not limited to that shown in FIG. 1. For example, the configuration of the present specification may be adapted to printers including an electrophotographic image forming device as well as other types of image forming apparatuses, such as copiers, facsimile machines, multifunction peripherals (MFP), and the like.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image carrier to bear a toner image;

a facing member disposed opposite and facing the image carrier via a transfer position at which the toner image is transferred onto a recording medium from the image carrier;

a power supply to output a voltage between a first position on the image carrier side from the transfer position and a second position on the facing member side from the transfer position;

a resistance detector to detect electrical resistance between the first position and the second position via the transfer position; and a controller to selectively switch between a first transfer mode, in which the power supply outputs only a direct current voltage, and a second transfer mode, in which the power supply outputs a superimposed voltage in which an alternating current voltage is superimposed on a direct current voltage, wherein, when the toner image on the image carrier is transferred onto the recording medium at the transfer position, the controller selects either the first transfer mode or the second transfer mode, and when the resistance detector detects the electrical resistance between the first position and the second position via the transfer position, the controller selects the first transfer mode.

2. The image forming apparatus according to claim 1, wherein the power supply comprises:

a direct-current voltage source to output the direct current voltage, when the first transfer mode is selected; and a superimposed voltage source to output the superimposed voltage in which the alternating current voltage is superimposed on the direct current voltage, when the second transfer mode is selected.

3. The image forming apparatus according to claim 2, further comprising a switch to cause the power supply to switch between the first transfer mode and the second transfer mode.

4. The image forming apparatus according to claim 2, wherein the resistance detector is provided in the direct-current voltage source.

5. The image forming apparatus according to claim 2, wherein the resistance detector detects the electrical resistance between the first position and the second position via the transfer position in a state in which the superimposed voltage source is turned off and the direct-current voltage source is turned on.

6. The image forming apparatus according to claim 1, wherein the power supply comprises:

a direct-current voltage source to output the direct current voltage; and an alternating-current voltage source to output an alternating current voltage, wherein, when the first transfer mode is selected, the direct-current voltage source outputs the direct current voltage, and when the second transfer mode is selected, the power supply outputs the superimposed voltage in which the alternating current voltage from the alternating-current voltage source is superimposed on the direct current voltage from the direct-current voltage source.

7. The image forming apparatus according to claim 1, wherein the resistance detector detects the electrical resistance between the first position and the second position via the transfer position in an interval between successive image forming operations.

8. The image forming apparatus according to claim 1, wherein the resistance detector detects the electrical resistance between the first position and the second position via the transfer position after predetermined number of successive image forming operations.

9. The image forming apparatus according to claim 1, wherein the resistance detector detects the electrical resistance between the first position and the second position via the transfer position when the image forming apparatus starts up.

10. The image forming apparatus according to claim 1, wherein the resistance detector detects the electrical resistance between the first position and the second position via the transfer position before adjustment of image forming conditions.

11. The image forming apparatus according to claim 1, wherein the controller corrects the output of the power supply during the second transfer mode depending on the electrical resistance between the first position and the second position via the transfer position detected by the resistance detector.

12. The image forming apparatus according to claim 1, further comprising an ambient condition detector to detect ambient conditions inside the image forming apparatus, wherein the resistance detector detects the electrical resistance between the first position and the second position via the transfer position based on the detection result of the ambient condition detector.

13. The image forming apparatus according to claim 12, wherein the ambient condition detector detects at least one of temperature, relative humidity, and absolute humidity inside the image forming apparatus.

14. The image forming apparatus according to claim 1, further comprising an ambient condition detector to detect ambient conditions in the image forming apparatus, wherein the controller corrects the output of the power supply during the second transfer mode based on the detection result of the ambient condition detector.

15. The image forming apparatus according to claim 1, wherein the controller corrects the output of the power supply during the second transfer mode depending on a size of the recording medium.

16. The image forming apparatus according to claim 1, wherein the toner image is transferred in the second transfer mode for a large-asperity recording medium.

17. The image forming apparatus according to claim 1, further comprising:

a second image carrier having a surface on which the toner image is formed, wherein the image carrier comprises an intermediate transfer member having a surface on which the toner image from the second image carrier is transferred, wherein the facing member comprises a secondary transfer member disposed opposite and facing the intermediate transfer member at the transfer position.

18. The image forming apparatus according to claim 17, further comprising a secondary transfer rear member to face the secondary transfer member via the intermediate transfer member and face a rear face of the intermediate transfer member, wherein the first position is a metal core of the secondary transfer rear member, and the second position is a metal core of the secondary transfer member.

19. The image forming apparatus according to claim 1, wherein the image carrier comprises a photoconductor to form and bear the toner image, and the facing member comprises a transfer member disposed opposite and facing the photoconductor at the transfer position to transfer the toner image on the photoconductor to the recording medium.

20. An image forming apparatus, comprising:

an image carrier to bear a toner image;

a facing member disposed opposite and facing the image carrier via a transfer position at which the toner on the image carrier is transferred onto a recording medium;

a power supply to output a voltage between a first position on the image carrier side from the transfer position and a second position on the facing member side from the transfer position;

the power supply comprising:

a direct-current voltage source to output a direct current voltage;

an alternating-current voltage source to output an alternating-current voltage;

a resistance detector to detect an electrical resistance between the first position and the second position via the transfer position;

a controller to cause the power supply to selectively switch between a first transfer mode, in which only the direct-current voltage source outputs the direct current voltage, and a second transfer mode, in which the alternating-current voltage source outputs the alternating current voltage;

wherein, when the toner image on the image carrier is transferred onto the recording medium in the transfer position, the controller selects either the first transfer mode or the second transfer mode;

when the resistance detector detects the electrical resistance between the first position and the second position via the transfer position, only the direct-current voltage source is on.

21. An image forming apparatus, comprising:

an image carrier to bear a toner image;

a transfer member to form a transfer portion to transfer the toner image from the image carrier onto a recording medium;

a power supply to output a voltage to the transfer portion;

a resistance detector to detect electrical resistance of the transfer portion; and a controller to selectively switch between a first mode, in which the power supply outputs only a direct current voltage, and a second mode, in which the power supply outputs a superimposed voltage in which an alternating current voltage is superimposed on a direct current voltage, wherein, when the toner image is transferred onto the recording medium, the controller selects either the first mode or the second mode, and when the resistance detector detects the electrical resistance, the controller selects the first mode.

22. The image forming apparatus according to claim 21, wherein the resistance detector detects the electrical resistance in an interval between successive image forming operations.

23. The image forming apparatus according to claim 21, wherein the resistance detector detects the electrical resistance after predetermined number of successive image forming operations.

24. The image forming apparatus according to claim 21, wherein the resistance detector detects the electrical resistance when the image forming apparatus starts up.

25. The image forming apparatus according to claim 21, wherein the resistance detector detects the electrical resistance before adjustment of image forming conditions.

26. The image forming apparatus according to claim 21, wherein the image carrier is an intermediate transfer belt, and the transfer member includes a secondary transfer roller that contacts an outer surface of the intermediate transfer belt.

27. The image forming apparatus according to claim 26, wherein the transfer member includes a secondary transfer rear roller that contacts an inner surface of the intermediate transfer belt.

28. The image forming apparatus according to claim 21, wherein the image carrier is an intermediate transfer belt, and the transfer member includes a secondary transfer belt that contacts an outer surface of the intermediate transfer belt.

29. The image forming apparatus according to claim 21, wherein the image carrier is a photoconductor to form and bear the toner image and the transfer member contacts a surface of the photoconductor.

30. The image forming apparatus according to claim 21, wherein the transfer portion includes a part of the image carrier.

* * * * *